United States Patent [19]

Brögger

[11] Patent Number: 4,798,120

[45] Date of Patent: Jan. 17, 1989

[54] BÖHM MECHANICAL SYSTEM FOR A WOODWIND

[76] Inventor: Luthier J. Brögger, Stoltenbergsgade 1, 1576 Copenhagen, Denmark

[21] Appl. No.: 897,215

[22] Filed: Aug. 18, 1986

[30] Foreign Application Priority Data

Jan. 6, 1986 [DK] Denmark ..... 36/86

[51] Int. Cl.[4] ..... G10D 9/04

[52] U.S. Cl. ..... 84/380 R; 84/384

[58] Field of Search ..... 84/380 R, 384, 385 R, 84/382, 386, 388, 390, 393–396

[56] References Cited

U.S. PATENT DOCUMENTS 4,376,403 3/1983 Haedrich et al. ..... 84/384

*Primary Examiner*—Benjamin R. Fuller

*Attorney, Agent, or Firm*—Fish & Richardson

[57] ABSTRACT

A woodwind instrument with a Böhm-system has rotating fixed keys movable in a rocking motion on the instrument body. A fixed nonrotating main axle is mounted on the instrument body. The keys are rotatably amounted upon the fixed nonrotating main axle. First and second coupling rods parallel to the main axle interconnect some of the keys for transferring rocking movement from one key to another. Tubular charniers rotatably mount the keys upon the main axle. A number of like loop clutches fitted to the tubular charniers transfer rocking motion to the keys mounted on the main axle from other keys mounted on the instrument body.

1 Claim, 2 Drawing Sheets

BöHM MECHANICAL SYSTEM FOR A WOODWIND

The invention is a Böhm-system having the mechanics in such a way, that the disadvantages connected with the ordinary Böhm-mechanics are avoided.

These disadvantages include friction, disadvantageous physical moment effect on side wings too close to the main axle, the main axles are placed in pivot suspensions and hinge pieces with pins fixed in holes drilled through the axles, thus weakening them.

A well known ordinarily Böhm mechanical system is constructed such, that the movements of the keys occur by means of two rotating axles placed in pivot suspensions with pointed screws, at the ends of the axles. The transferring of the movement of one key to other keys, takes place via the two rotating axles by means of pins inserted in the axles though a lot of holes drilled through these axles.

It is also known, that the side wings fixed to these hinge pieces with pins, sitting close to the axles, are not uniform in design; which causes a different physical effect of moment on different keys.

In such a principle of construction it has however not been possible to avoid first, a vulnerable mechanical construction caused by the pivot suspension of the two rotating axles, and weakening of these caused by the many holes drilled through these to fix the pins. Second: A series of problems caused by friction has been impossible to eliminate, thus giving a certain slowness in operating the system of keys. This is especially evident concerning the G and B (H) keys, which are fixed with a pin to each axle suspended in a pivot-suspension.

The pressure of the needle springs against the charniers (small movable hinge tubes, slipped over the rotating axles), sets a limit to how easy the running of the keys can become. The turning moment (torque) is transferred, in different distances from the centre of the axle, on a traditional Böhm mechanical system.

It is now possible to avoid these disadvantages by means of a mechanical construction according to the invention.

By this invention, the problems concerning the unwanted friction in the mechanical system, have been eliminated to a very high degree, because of a system of coupling rods, where the transferring of the movement of some keys to others occurs. The loop clutches and side wings are designed uniformly, transferring of the turning moment (torque) from one key to another at the same distance from the centre of the axle. Different from the traditional system, the new system features a solid non rotatable main-axle, not weakened because of holes to fix pins, thus giving far better stability than the former pivot-suspension.

The following is a description of the construction principle for the invention, referring to the enclosed drawings, where:

Figures 1, 2:
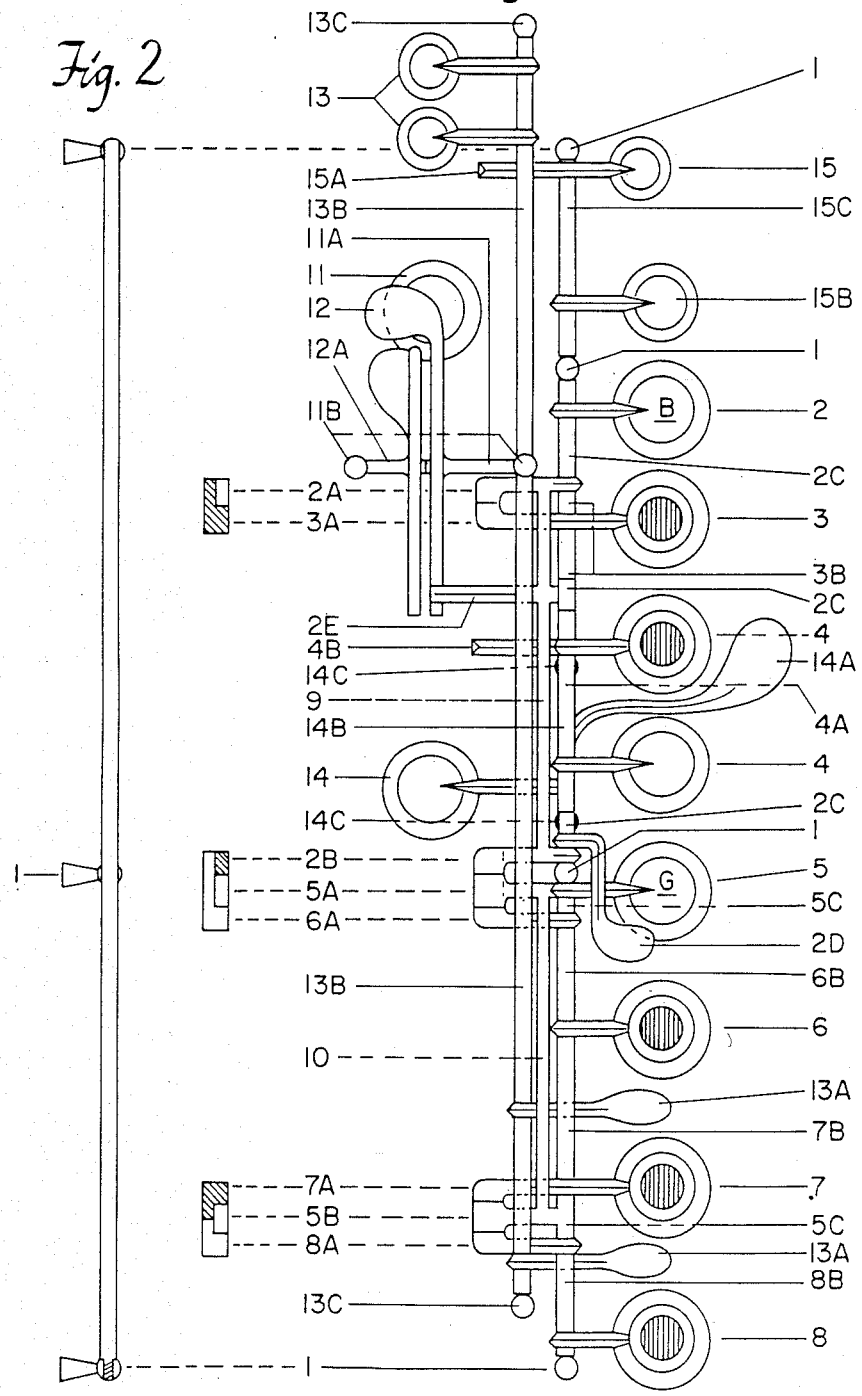
FIG. 1 shows a mechanical system according to the principles of construction of the invention.
FIG. 2 shows a continuous main-axle.

The mechanical system shown in the drawings comprises a fixed nonrotating main-axle 1. Keys are rotatably mounted upon main axle 1 by tubular charniers. Two sets of loop clutches, 5A-5B and 2A-2B are interconnected by rods 10 and 9, respectively there is a fixed external connection by means of coupling rod 10 between the loop clutches 5A-5B, as well as external coupling rod 9 between the loop clutches 2A-2B, FIG. 3 and FIG. 1. The transferring of the movements of the keys, take place through the coupling rods 1o and 9 via the connected loop clutches 5A-5B and 2A-2B, according to the new principle of construction. This principle of construction concerning the loop clutches 2B-5A-6A is repeated in the case of 7A-5B-8A as well as 2A-3A on FIG. 1.

Figure 3:
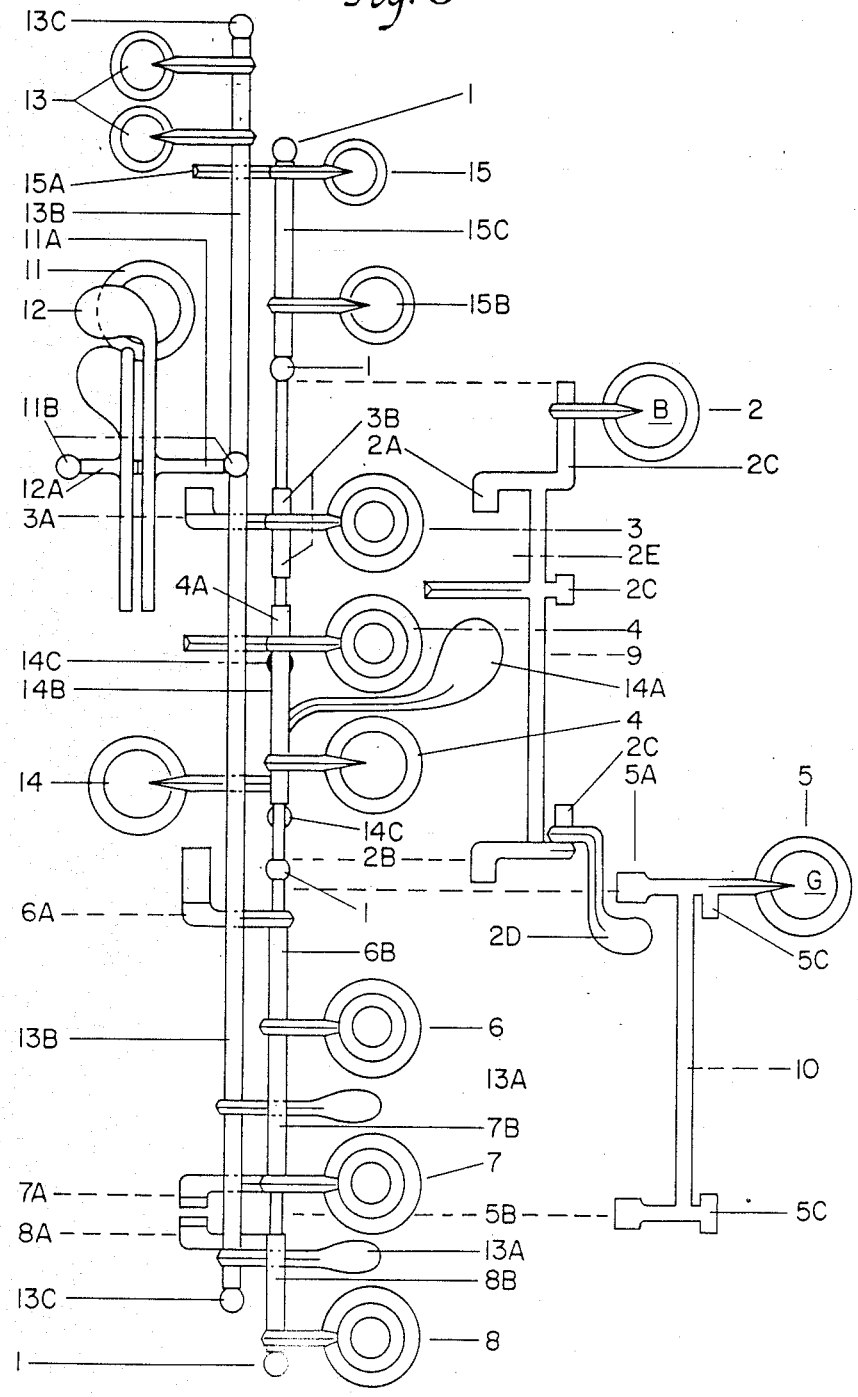
FIG. 3 shows parts of the mechanical system characteristic for the invention.

Describing the structure in greater detail with specific reference to FIGS. 1 and 3, a flute embodiment according to the invention includes main line posts 1. Each of the various keys specifically identified comprises a cup and arm. There is B key 2, loop clutches 2A and 2B, charnier 2C, B trill lever 2D and B or thumb kicker 2E. There is B-flat key 3, side wing 3A, charnier 3B, A key 4, charnier 4A, A tail 4B, G key 5, loop clutches 5A and 5B and charnier 5C. There is F-sharp key 6, side wing 6A, charnier 6B, F key 7, side wing 7A and charnier 7B. There is E key 8, side wing 8A, charnier 8B and left- and right-hand coupling rods 9 and 10, respectively. There is C thumb key 11, charnier 11A, thumb key posts 11B, B thumb key 12, charnier 12A, trill keys 13, trill levers 13A, charnier 13B and trill posts 13C. There is G-sharp key 14, G-sharp lever 14A, G-sharp charnier 14B suspended below, G-sharp posts 14C, C-sharp key 15, C-sharp tail 15A, C-sharp key touch piece 15B and charnier 15C.

Keys 2, 3, 4, 5, 6, 7 and 8 have associated charniers 2C, 3B, 4A, 5C, 6B, 7B and 8B, respectively, mounted on a fixed axle supported by posts 1. In the rest position, springs (not shown) hold the keys 2–8 open in a conventional manner.

The invention allows the player to use a traditional Bohm fingering system whereby closing keys 8, 7 and 6 also closes key 5 without affecting any other key. For example, closing key 6 closes key 5 without affecting keys 8 or 7.

Closing key 6 closes keys 2 and 5 simultaneously without affecting keys 3, 4, 7, 8 or any other key. Closing key 3 also closes key 2 without affecting any other key. Closing key 12 also closes key 2 without affecting any other key.

The illustrated series of loop clutches, side wings and coupling rods coact with keys to effect these closings.

For example, key 8 closes key 5 in the following manner. Closing key 8 rotates charnier 8B about the surrounded fixed axle. Attached side wing 8A engages loop clutch 5B, attached to charnier 5C, causing the assembly including charnier 5C to rotate about the fixed axle with side wing 8A. Right-hand coupling bridge 10 then also rotates about the axle, causing key 5 to close with key 8. Keys 6 and 7 are not affected by these closings because all the motion occurs outside their mechanical connection to the flute.

In a similar manner closing keys 6 and 7 closes key 5, closing key 6, closes key 2, closing key 3 closes key 2 and closing key 12 closes key 2.

Other embodiments are within the claim.

I claim:

1. In a Böhm-system for a woodwind instrument having rotating fixed keys movable in a rocking motion on the instrument body the improvement comprising, a fixed nonrotating main axle mounted on the instrument body, said keys being rotatably mounted upon said fixed nonrotating main axle, first and second coupling rods parallel to said main axle interconnecting some of the keys for transferring rocking movement from one key to another, tubular charniers rotatably mounting said keys upon said main axle, .

and a plurality of like loop clutches fitted to said tubular charniers for transferring rocking motions to said keys mounted on said main axle from other keys mounted on said instrument body.

* * * * *